US006801133B1

(12) United States Patent
Ham

(10) Patent No.: US 6,801,133 B1
(45) Date of Patent: Oct. 5, 2004

(54) ELECTRICAL WIRING MONITORING SYSTEM

(76) Inventor: Edgardo Ham, 916 Ysidora Ave., Chula Vista, CA (US) 91910

( * ) Notice: Subject to any disclaimer, the term of this patent is extended or adjusted under 35 U.S.C. 154(b) by 54 days.

(21) Appl. No.: 10/328,980

(22) Filed: Dec. 26, 2002

(51) Int. Cl.[7] ..... G08B 17/00

(52) U.S. Cl. ..... 340/584; 340/640; 340/577; 340/578; 340/581; 340/635; 340/501

(58) Field of Search ..... 340/640, 584, 340/577, 578, 588, 581, 635, 501, 506, 310.06

(56) References Cited

U.S. PATENT DOCUMENTS 4,102,196 A 7/1978 Holtermann
4,547,658 A 10/1985 Crowley
4,556,882 A 12/1985 Brifman et al.
5,424,895 A 6/1995 Gaston
5,883,568 A 3/1999 Boyden
5,909,180 A * 6/1999 Bailey et al. ..... 340/639
D429,701 S 8/2000 Maruta et al.
6,231,227 B1 * 5/2001 Andersen ..... 374/4
6,441,723 B1 * 8/2002 Mansfield et al. ..... 340/310.01

* cited by examiner

*Primary Examiner*—Jeffery Hofsass
*Assistant Examiner*—Hung Nguyen

(57) ABSTRACT

An electrical wiring monitoring system for sensing overheating of electrical lines which could result in electrical fires. The electrical wiring monitoring system includes a housing member having front and side walls and being adapted to be mounted to a wall structure near a fuse box; and also includes a cover member being hingedly attached to the housing member and being closeable over the front wall of the housing member; and further includes a monitor assembly including a microprocessor being disposed in the housing member, and also including a power source being connected to the microprocessor, and further including an alarm-sounding assembly being connected to the microprocessor, and also including an electrical line control/display assembly being connected to the microprocessor; and also includes wire overheating detection members being connected to the microprocessor and being attached about electrical wires of electrical lines.

3 Claims, 2 Drawing Sheets

ELECTRICAL WIRING MONITORING SYSTEM

BACKGROUND OF THE INVENTION

1. Field of the Invention

The present invention relates to electrical line monitors and more particularly pertains to a new electrical wiring monitoring system for sensing overheating of electrical lines which could result in electrical fires.

2. Description of the Prior Art

The use of electrical line monitors is known in the prior art. More specifically, electrical line monitors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,883,568; U.S. Pat. No. 5,424,895; U.S. Pat. No. 4,102,196; U.S. Pat. No. 4,556,882; U.S. Pat. No. 4,547,658; and U.S. Pat. No. Des. 429,701.

While these devices fulfill their respective, particular objectives and requirements, the aforementioned patents do not disclose a new electrical wiring monitoring system. The prior art includes circuit breakers like that of fuse boxes, but does not include alarms to signal overheating of the electrical lines.

SUMMARY OF THE INVENTION

The general purpose of the present invention, which will be described subsequently in greater detail, is to provide a new electrical wiring monitoring system which has many of the advantages of the electrical line monitors mentioned heretofore and many novel features that result in a new electrical wiring monitoring system which is not anticipated, rendered obvious, suggested, or even implied by any of the prior art electrical line monitors, either alone or in any combination thereof. The present invention includes a housing member having front and side walls and being adapted to be mounted to a wall structure near a fuse box; and also includes a cover member being hingedly attached to the housing member and being closeable over the front wall of the housing member; and further includes a monitor assembly including a microprocessor being disposed in the housing member, and also including a power source being connected to the microprocessor, and further including an alarm-sounding assembly being connected to the microprocessor, and also including an electrical line control/display assembly being connected to the microprocessor; and also includes wire overheating detection members being connected to the microprocessor and being attached about electrical wires of electrical lines. None of the prior art includes the combination of the elements of the present invention.

There has thus been outlined, rather broadly, the more important features of the electrical wiring monitoring system in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new electrical wiring monitoring system which has many of the advantages of the electrical line monitors mentioned heretofore and many novel features that result in a new electrical wiring monitoring system which is not anticipated, rendered obvious, suggested, or even implied by any of the prior art electrical line monitors, either alone or in any combination thereof.

Still another object of the present invention is to provide a new electrical wiring monitoring system for sensing overheating of electrical lines which could result in electrical fires.

Still yet another object of the present invention is to provide a new electrical wiring monitoring system that is easy and convenient to set up and install.

Even still another object of the present invention is to provide a new electrical wiring monitoring system that would prevent the occurrence of fires to building structures caused by the overheating of electrical lines.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
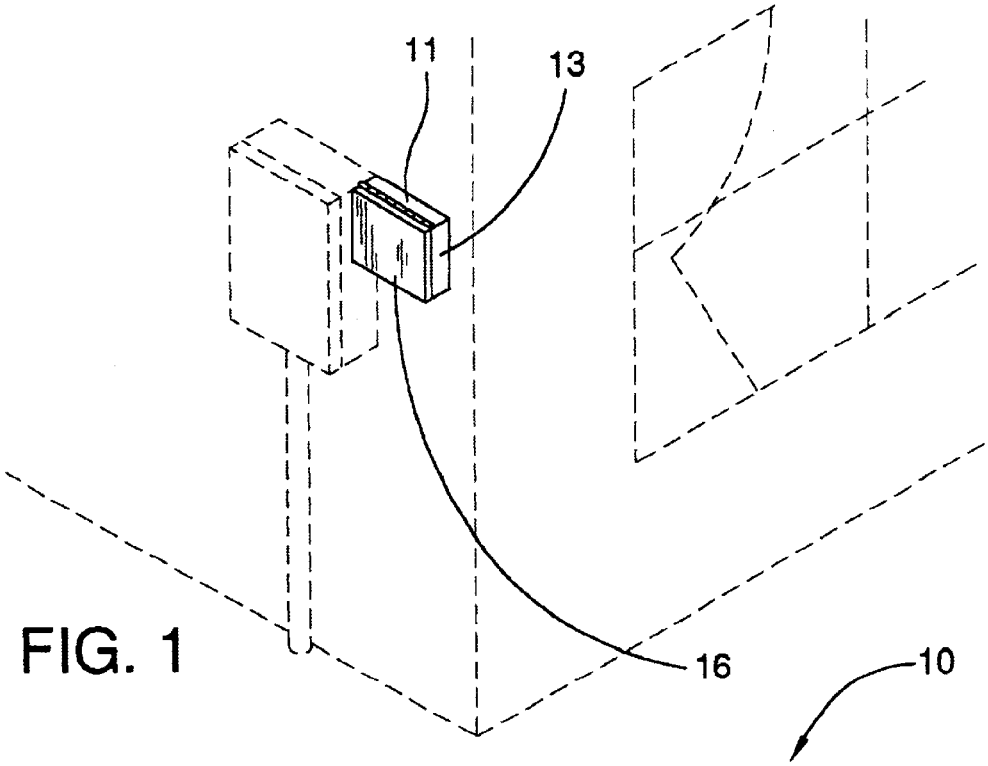
FIG. 1 is a perspective view of a new electrical wiring monitoring system according to the present invention.
Figure 2:
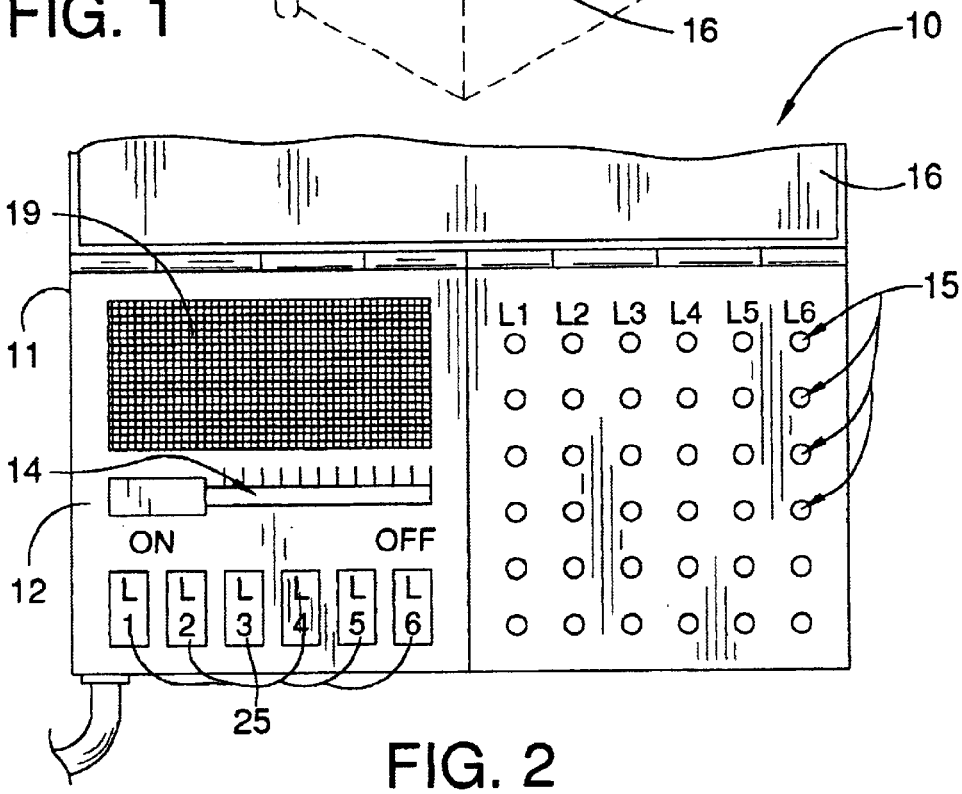
FIG. 2 is a front elevational view of the present invention.
Figure 3:
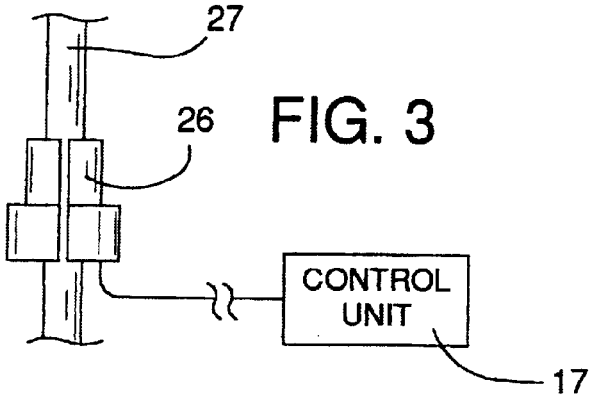
FIG. 3 is a detailed elevational view of a heat sensor attached to an electrical wire of the present invention.
Figure 4:
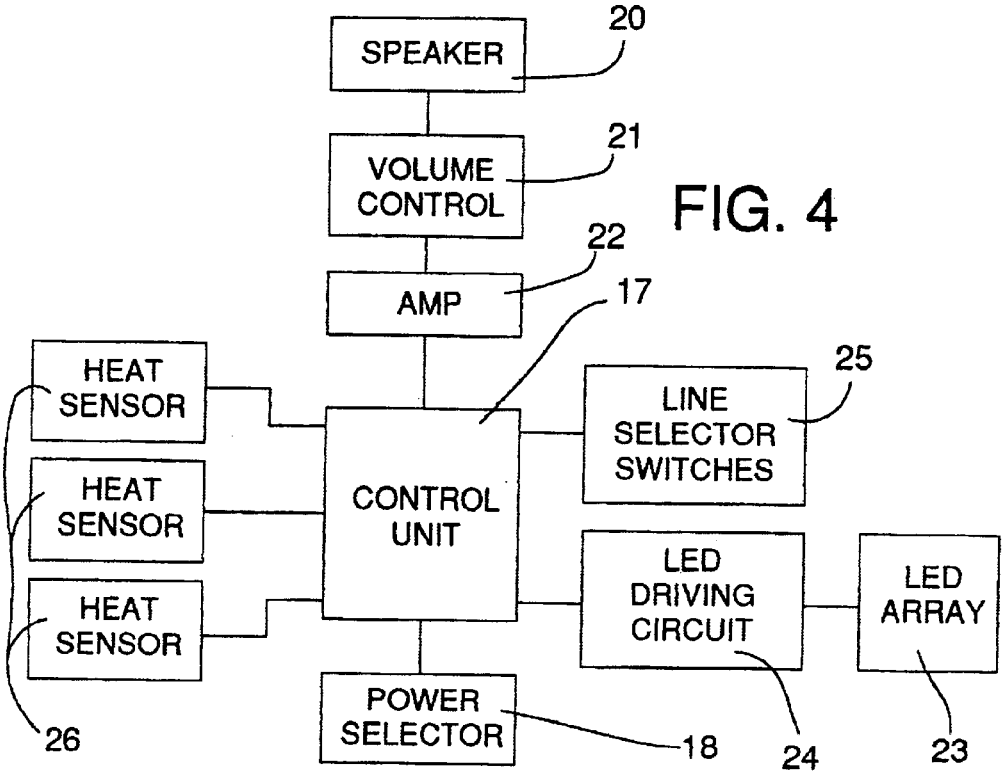
FIG. 4 is a schematic diagram of the present invention.

With reference now to the drawings, and in particular to FIGS. 1 through 4 thereof, a new electrical wiring monitoring system embodying the principles and concepts of the present invention and generally designated by the reference numeral 10 will be described.

As best illustrated in FIGS. 1 through 4, the electrical wiring monitoring system 10 generally comprises a housing member 11 having front and side walls 12,13 and being adapted to be mounted and fastened with fasteners to a wall structure near a fuse box. The housing member 11 includes an elongate slot 14 being disposed through the front wall 12 thereof, and also includes a plurality of holes 15 being disposed through the front wall 12 and being spacedly arranged in rows and columns with each column being associated with a particular electrical line 27 being connected to the fuse box. A cover member 16 is hingedly attached to the housing member 11 and is closeable over the front wall 12 of the housing member 11.

A monitor assembly includes a microprocessor 17 being disposed in the housing member 11 with selected heat indexes or temperatures being programmed into the microprocessor 17, and also includes a power source 18 being conventionally connected to the microprocessor 17, and further includes an alarm-sounding assembly being connected to the microprocessor 17, and also includes an electrical line control/display assembly being connected to microprocessor 17. The alarm-sounding assembly includes a speaker grill 19 being conventionally disposed in the front wall 12 of the housing member 11, and also includes a speaker 20 being disposed in the housing member proximate to the speaker grill 19 and being conventionally connected to the microprocessor 17, and further includes a volume control switch 21 being slidably mounted through the elongate slot 14 of the housing member II and being conventionally connected to the speaker 20 and to the microprocessor 17, and also includes an amplifier 22 being conventionally connected to the microprocessor 17 and to the volume control switch 21. The electrical line control/display assembly includes a plurality of light-emitting members 23 being conventionally disposed in the front wall 12 of the housing member 11 to display which electrical lines are being monitored, and also includes a light-emitting circuit 24 being conventionally connected to the light-emitting members 23 and to the microprocessor 17, and further includes electrical line selector switches 25 being movably disposed in the front wall 12 of the housing member 11 and being conventionally connected to the microprocessor 17 for selecting which electrical lines 27 are to be monitored. The light-emitting members 23 are disposed in the holes 15 of the front wall 12 of the housing member 11 with a column of the light-emitting members 23 with associated with a particular the electrical line 27.

Wire overheating detection members 26 are conventionally connected to the microprocessor 17 and are attached about electrical wires of electrical lines 27. The wire overheating detection members 26 are heat sensors which are sleeves being engaged about the electrical wires connected to the fuse box.

In use, the user selects which electrical lines 27 are to be monitored by depressing the particular electrical line selector switches 25 with the associated light-emitting members 23 for the particular electrical lines 27 being illuminated. Selected heat indexes or temperatures are programmed into the microprocessor 17, and should the microprocessor 17 get temperature readings from the heat sensors 26 that reach the programmed heat indexes or temperatures, the microprocessor will signal an audible alarm through the speaker 20 to warn the user of a particular electrical line 27 being overheated so that the user can shutdown the electrical usage of that electrical line 27 to prevent any possible fires.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the electrical wiring monitoring system. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electrical wiring monitoring systems comprising:

a housing member having front and side walls and being adapted to be mounted to a wall structure near a fuse box, said housing member including an elongate slot being disposed through said front wall thereof, and also including a plurality of holes being disposed through said front wall and being spacedly arranged in rows and columns with each said column being associated with a particular electrical line being connected to the fuse box;

a cover member being hingedly attached to said housing member and being closeable over said front wall of said housing member a monitor assembly including a microprocessor being disposed in said housing member with selected heat indexes or temperature being programmed into said microprocessor, and also including a power source being connected to said microprocessor, and further including an alarm-sounding assembly being connected to said microprocessor, and also including an electrical line control/display assembly being connected to microprocessor, said alarm-sounding assembly including a speaker grill being disposed in said front wall of said housing member, and also including a speaker being disposed in said housing member proximate to said speaker grill and being connected to said microprocessor, and further including a volume control switch being slidably mounted through said elongate slot of said housing member and being connected to said speaker and to said microprocessor, and also including an amplifier being connected to said microprocessor and to said volume control switch, said electrical line control/display assembly including a plurality of light-emitting members being disposed in said front wall of said housing member to display which said electrical lines are being monitored, and also including a light-emitting circuit being connected to said light-emitting members and to said microprocessor, and further including electrical line selector switches being movably disposed in said front wall of said housing member and being connected to said microprocessor for selecting which electrical lines to be monitored; and wire overheating detection members being connected to said microprocessor and being attached about electrical wires of electrical lines.

2. An electrical wiring monitoring system as described in claim 1, wherein said light-emitting members are disposed in said holes of said front wall of said housing member with a column of said light-emitting members with associated with a particular said electrical line.

3. An electrical wiring monitoring system as described in claim 2, wherein said wire overheating detection members are heat sensors which are engaged about the electrical wires connected to the fuse box.

* * * * *